US011165162B1

(12) United States Patent
Davenport

(10) Patent No.: US 11,165,162 B1
(45) Date of Patent: Nov. 2, 2021

(54) DICHROIC SPHERICAL ANTENNA

(71) Applicant: New Mexico Aerospace LLC, Dover, DE (US)

(72) Inventor: Benjamin James Davenport, Las Cruces, NM (US)

(73) Assignee: New Mexico Aerospace LLC, Dover, DE (US)

( * ) Notice: Subject to any disclaimer, the term of this patent is extended or adjusted under 35 U.S.C. 154(b) by 0 days.

(21) Appl. No.: 16/391,153

(22) Filed: Apr. 22, 2019

Related U.S. Application Data

(60) Provisional application No. 62/634,062, filed on Feb. 22, 2018.

(51) Int. Cl.

| | |
|---|---|
| ***H01Q 15/00*** | (2006.01) |
| ***H01Q 15/14*** | (2006.01) |
| ***H01Q 5/45*** | (2015.01) |
| ***H01Q 3/14*** | (2006.01) |

(52) U.S. Cl.
CPC ..... *H01Q 15/0013* (2013.01); *H01Q 3/14* (2013.01); *H01Q 5/45* (2015.01); *H01Q 15/142* (2013.01)

(58) Field of Classification Search
None
See application file for complete search history.

(56) References Cited

U.S. PATENT DOCUMENTS

| | | | | |
|---|---|---|---|---|
| 4,595,623 | A * | 6/1986 | Du Pont | C08J 9/32 428/195.1 |
| 6,452,564 | B1 * | 9/2002 | Schoen | H01Q 1/525 324/338 |
| RE43,699 | E * | 10/2012 | Anderson | H01Q 1/366 343/701 |
| 2008/0130018 | A1 * | 6/2008 | Steenblik | G09F 3/00 356/625 |
| 2012/0038532 | A1 * | 2/2012 | Yonetsu | H01Q 17/00 343/787 |
| 2015/0209691 | A1 * | 7/2015 | Ferrer | D01F 6/12 210/799 |
| 2015/0229032 | A1 * | 8/2015 | Liu | H01Q 3/20 343/766 |

* cited by examiner

*Primary Examiner* — Crystal L Hammond
(74) *Attorney, Agent, or Firm* — Insigne PC

(57) ABSTRACT

The present disclosure relates to a dichroic spherical antenna. In one embodiment of the present disclosure, a dichroic spherical antenna comprises a collector disposed within a spherically-shaped reflector; wherein the reflector comprises a coating. In some embodiments, the coating comprises a plurality of ferromagnetic particles dispersed throughout an epoxy-based medium. In some embodiments, the collector's interior is held at a pressure less than the pressure exerted on the exterior of the collector. The present disclosure also relates to a method of receiving radio signals, the method comprising the steps of receiving, at a collector disposed inside a spherical reflector, electromagnetic radiation; wherein the exterior of the reflector comprises a coating.

14 Claims, 4 Drawing Sheets

DICHROIC SPHERICAL ANTENNA

CROSS-REFERENCE TO RELATED APPLICATIONS

The present application claims benefit of U.S. Provisional Application No. 62/634,062 filed on Feb. 22, 2018 and entitled, "Dichroic Spherical Antenna," the entire disclosure of which is fully incorporated herein by reference.

BACKGROUND OF THE INVENTION

1. Field of Invention

The present disclosure relates to antennae and signal reception and, more specifically, a dichroic spherical antenna.

2. Description of Related Art

Aperture antennas are the main type of directional antennas used at microwave frequencies and above. Generally, such antennas comprise a small dipole or loop feed antenna inside a three-dimensional guiding structure that is large as compared to the wavelength, and an aperture to emit radio waves.

There are two basic types of aperture antennas currently used in the art. The first is a parabolic aperture antenna and is the most widely used high-gain antenna at microwave frequencies and above. Generally, such antennas comprise a dish-shaped metallic, parabolic reflector with a feed antenna located at the focus. Parabolic aperture antennas are typically used for radar systems, point-to-point data links, satellite communication, and radio telescopes. The second basic type of aperture antenna is a horn antenna. Generally, such antennas comprise a flaring metal horn attached to a waveguide and are typically used in radar guns, radiometers, and as feed antennas for parabolic dishes.

The current state of the art also includes the Cassegrain antenna, a design that increases the sensitivity of the parabolic aperture antennas. Such a design comprises a parabolic aperture antenna having a feed antenna mounted at or behind the surface of the concave main parabolic reflector dish and aimed at a smaller convex secondary reflector suspended in front of the primary reflector.

One disadvantage to parabolic antennas is that they are unidirectional, i.e., the antenna needs to be pointed in a specific direction to receive the desired signal. Often, such antennas are very large as they have to be many times to the size of the wavelength to be received. Thus, to properly position a typical parabolic antenna, large motors and gears must be affixed to the antenna such that it can be pointed at a specific azimuth and elevation.

Another disadvantage to aperture antennas is that they suffer from beam squint—the change in beam direction as a function of its operating frequency, polarization, or orientation. More specifically, squint refers to the angle that the transmission is offset from the normal of the plane of the antenna and limits the antenna's operable bandwidth.

Therefore, what is needed is an omnidirectional antenna that is small in size and does not require additional hardware to direct the antenna. This need has heretofore remained unsatisfied.

SUMMARY OF THE INVENTION

The present disclosure overcomes these and other deficiencies of the prior art by providing a frequency selective, dichroic spherical antenna having a parabolic and spherical reflector used to focus received electromagnetic waves at the center of the spherical reflector for collection. The internal reflector is curved in the form of a continuous paraboloid. The parabolic shape directs the radio waves from the feed point at the focus to the reflector such that the paths taken are in parallel and are roughly the same length, therefore the outgoing waveform will form a plane wave and the energy taken by all paths will be in phase. The spherical shape enables a very accurate beam to be obtained. Resultantly, the feed system forms the radiating section of the antenna, and the reflecting parabolic surface enables passive amplification of the received radio signals at the center of the reflector for collection.

In an exemplary embodiment of the present disclosure, a dichroic spherical antenna comprises a spherically-shaped reflector having an exterior surface and an interior, a collector disposed at the center of the reflector, and a coating disposed on the exterior surface of the reflector. In some embodiments, the dichroic spherical antenna's coating comprises a plurality of ferromagnetic particles dispersed throughout a coating medium. In some embodiments, the coating medium is epoxy-based. In some embodiments, the plurality of ferromagnetic particles comprise polymethylmethacrylate microspheres. In some embodiments, the microspheres comprise a radio frequency conductive silver coating. In some embodiments, the microspheres are between 125 micrometers and 150 micrometers in diameter. In another embodiment, the collector is capable of receiving radio frequency band electromagnetic radiation. In some embodiments, the pressure inside the reflector's interior is less than the pressure outside the reflector. In some embodiments, the collector is disposed at the geometric focus of the reflector.

In another exemplary embodiment of the present disclosure, a method of receiving radio signals comprises the steps of receiving, at a collector disposed inside a spherical reflector, electromagnetic radiation, wherein the exterior of the reflector comprises a coating. In some embodiments, the coating comprises ferromagnetic particles. In some embodiments, the ferromagnetic particles comprise polymethylmethacrylate microspheres. In some embodiments, the microspheres are between 125 micrometers and 150 micrometers in diameter. In some embodiments, the frequency of the electromagnetic radiation is between 3 kHz and 300 GHz.

In another exemplary embodiment of the present disclosure, a coating for antennas comprises a plurality of ferromagnetic particles dispersed throughout a medium. In some embodiments, the coating's medium is epoxy-based. In other embodiments, the plurality of ferromagnetic particles comprises polymethylmethacrylate microspheres. In other embodiments, the plurality of ferromagnetic particles has a diameter between 125 micrometers and 150 micrometers. In other embodiments, the plurality of ferromagnetic particles comprises a radio frequency conductive silver coating.

The foregoing and other features and advantages of the invention will be apparent from the following, more particular description of the preferred embodiments of the invention, the accompanying drawings, and the claims.

BRIEF DESCRIPTION OF THE DRAWINGS

For a more complete understanding of the present disclosure, the objects and advantages thereof, reference is now made to the ensuing descriptions taken in connection with the accompanying drawings briefly described as follows.

DETAILED DESCRIPTION OF EMBODIMENTS

Figure 1:
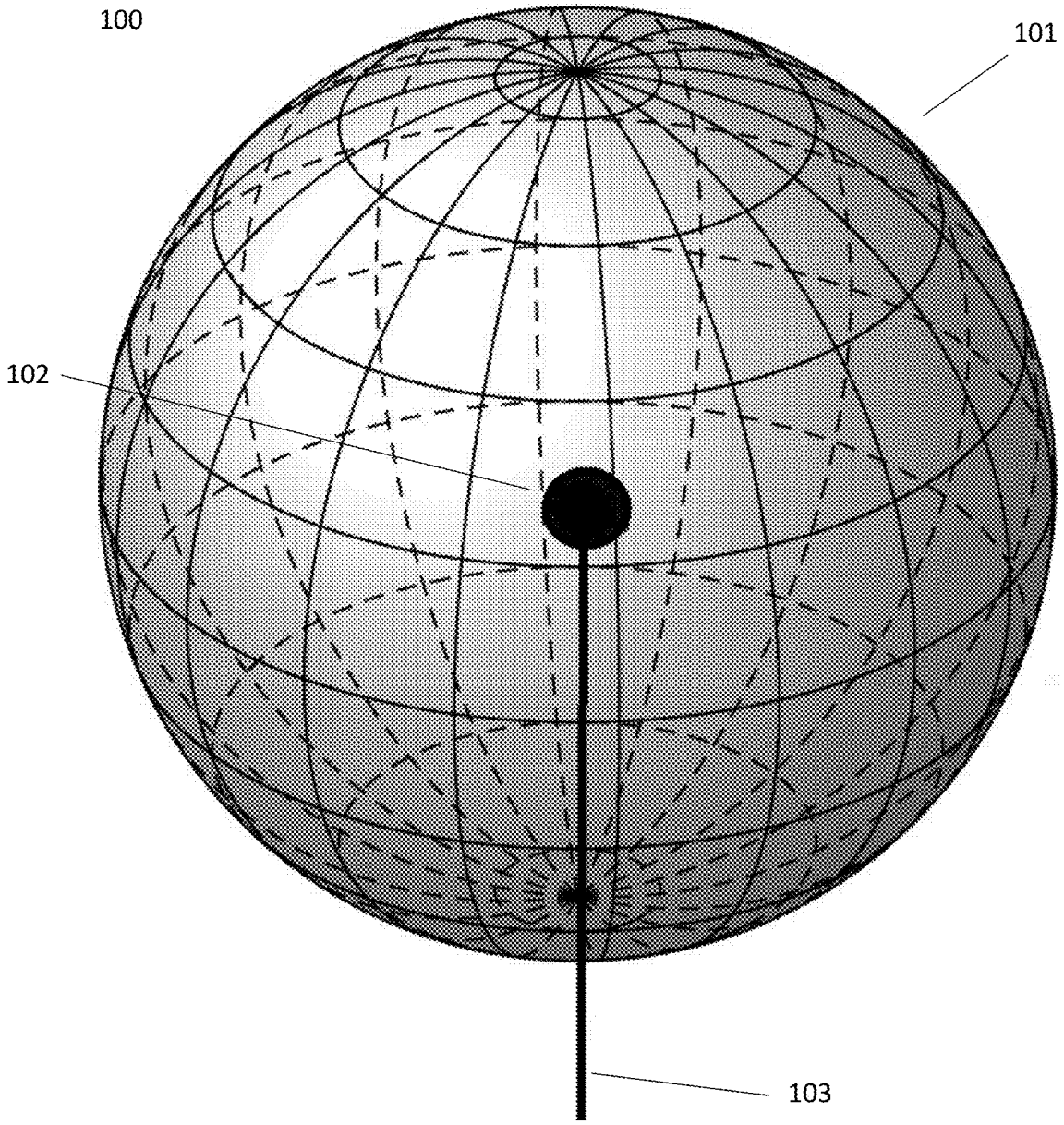
FIG. 1 illustrates an isometric view of a dichroic spherical antenna, according to an exemplary embodiment of the present disclosure.

Further features and advantages of the disclosure, as well as the structure and operation of various embodiments of the disclosure, are described in detail below with reference to the accompanying FIGS. 1-4. Although the disclosure is described in the context of an antenna, the term antenna refers to any type of device capable of receiving and/or interacting with electromagnetic waves including, but not limited to, radio waves.

In an exemplary embodiment of the present disclosure, a dichroic spherical antenna comprises a reflector and a collector. In an embodiment, the reflector is spherically shaped. As used herein, the term "spherically-shaped" includes any shape that has at least a portion that is spherical. The collector is mounted to the reflector such that it is located at the center of the reflector. In some embodiments, the reflector is configured such that the interior of the reflector is held at vacuum during operation. This may be achieved at the time of manufacture or by other apparatuses connected to or installed onto the spherical antenna that maintain a desired vacuum. In some embodiments, the interior vacuum is held at approximately 1 torr.

In an exemplary embodiment, the collector is mounted such that it is located in the geometric center of the reflector. The collector may be fixed to the reflector and have a connector that is suitable for the desired frequency to be received. For example, SMA-, N-, TNC-, SMC-, MCX-, BNC-, SMB-, Mini-UHF-, and UHF-type connectors may be used. The collector is configured such that it is able to receive radio signals from substantially every angle. In some embodiments, the collector further comprises a Low Noise Amplifier (LNA or LNB).

In an exemplary embodiment, the reflector is made from a rigid or semi-rigid material. In some embodiments, the reflector is made from a material having a suitable dielectric constant within a range of 1 to 3.5. For example, the reflector may comprise Nylon or Teflon having a dielectric constant of 2.1. In other embodiments, other polymers may be utilized. Exemplary polymers may include, and are not limited to, foam polyethylene (dielectric constant of ~1.6), fluoropolymers (dielectric constant of ~2.0), butyl rubber (dielectric constant of ~2.3), styrene-butadiene rubber (dielectric constant of ~2.9), silicone rubber (dielectric constant of ~3.2), plexiglass (dielectric constant of ~3.4), and polyvinyl chloride (dielectric constant of ~4.0).

In another exemplary embodiment of the present disclosure, the reflector comprises a coating comprising ferromagnetic material suspended in a medium. Conceptually, the coating serves to capture incoming electromagnetic waves and direct those waves to the interior of the reflector without the waves bouncing off the exterior surface of the reflector. The physical properties of the coating and the reflector enable the wave to be directed to and through the reflector while enabling the wave to be captured within the interior of the reflector. In an exemplary embodiment, an epoxy may be used as the medium having ferromagnetic material suspended therein at a substantially homogeneous mixture. Some embodiments may comprise a single reflector while others may comprise a plurality of reflectors.

In one embodiment, the ferromagnetic material may by methyl methacrylate having a conductive coating. For example, the ferromagnetic material may be highly spherical poly methyl methacrylate ("PMMA") microspheres having an RF conductive silver coating. In such an example, the PMMA microspheres may be between 125 and 150 micrometers in diameter and have a silver coating of approximately 250 nanometers thick. The density of such PMMA microspheres is approximately 1.2-1.3 grams per cubic centimeter.

In another exemplary embodiment, the composition of the coating may be approximately one gram of ferromagnetic material to three grams of epoxy. In such an embodiment, the coating may be mixed at a 1:3 ratio of ferromagnetic material to epoxy by weight. The coating may be applied to the exterior, the interior, or both the exterior and interior of the reflector. In some embodiments, the number of ferromagnetic particles an incoming wave encounters influences what frequency of wave is collected. For example, the greater the number of ferromagnetic particles, the higher the frequency of wave is collected. This can be achieved by either a combination of increasing the thickness of the coating containing ferromagnetic material or increasing the density of the ferromagnetic material disbursed within the coating. In some embodiments, the coating has varying densities of ferromagnetic material.

The collector is sized according to the wavelength to be received. In an exemplary embodiment, the diameter of the reflector is sized such that its diameter is ½ of the desired wavelength. In an exemplary embodiment, the reflector's diameter is within 1% of ½ of the desired wavelength to be received. Determining the wavelength of the desired frequency is well-known in the art by using Planck's Equation of $$\gamma = \frac{c}{v}$$

where:

γ=wavelength c=the speed of light in a vacuum v=the frequency

For example, in an embodiment configured to receive a 2 GHz signal, the reflector's diameter is 7.49808 cm, +/−0.0749808 cm. Other exemplary desired sizes of reflectors are given with reference to specific RF bands:

| | Frequency (GDz) | | Wavelength | | Antenna Reflector Appx. Diameter (cm) | |
|---|---|---|---|---|---|---|
| RF band | Min | Max | Min | Max | Min | Max |
| P | 0.255 | 0.390 | 76.900 | 133.000 | 38.450 | 19.225 |
| L | 0.390 | 1.550 | 19.300 | 76.900 | 9.650 | 4.825 |
| S | 1.550 | 4.200 | 7.100 | 19.300 | 3.550 | 1.775 |
| C | 4.200 | 5.570 | 5.200 | 7.100 | 2.600 | 1.300 |
| X | 5.570 | 10.900 | 2.700 | 5.200 | 1.350 | 0.675 |
| K | 10.900 | 36.000 | 0.830 | 2.700 | 0.415 | 0.208 |
| Ku | 10.900 | 22.000 | 1.360 | 2.700 | 0.680 | 0.340 |
| Ka | 22.000 | 36.000 | 0.830 | 1.360 | 0.415 | 0.208 |

-continued

| | Frequency (GDz) | | Wavelength | | Antenna Reflector Appx. Diameter (cm) | |
|---|---|---|---|---|---|---|
| RF band | Min | Max | Min | Max | Min | Max |
| Q | 36.000 | 46.000 | 0.650 | 0.830 | 0.325 | 0.163 |
| V | 46.000 | 56.000 | 0.530 | 0.650 | 0.265 | 0.133 |
| W | 56.000 | 100.000 | 0.300 | 0.530 | 0.150 | 0.075 |

While references to specific electromagnetic wave bands are made herein, other embodiments of the disclosure may be utilized for other frequencies of electromagnetic waves having different reflector sizes, without departing from embodiments contemplated herein. For example, the dichroic spherical antenna may be configured to receive electromagnetic radiation lower than thirty (30) hertz (Hz) and in excess of three (3) Tera hertz (THz).

In another embodiment, the dichroic spherical antenna may be mounted to a grounded dielectric substrate. For example, the dichroic spherical antenna may be installed on a grounded dielectric slab. In such an embodiment, the slab creates a high-impedance absorbing surface to increase the sensitive of the antenna.

In an exemplary embodiment of the present disclosure and with reference to FIG. 1, a dichroic spherical antenna 100 comprises a reflector 101 and a collector 102. The reflector 101 is substantially spherically shaped. The collector 102 is located at or near the three-dimensional geometric center of the collector 101. In some embodiments, the collector 102 comprises a low-pass filter. Exemplary low-pass filters include a LNA and a LNB filter, the use and application of which is readily apparent to one skilled in the art. The interior of the collector 101 may comprise a vacuum. In some embodiments, the interior of the collector 101 maintains a vacuum of 1 torr. A connector 103 may be attached to the collector 102. In some embodiments, the connector 103 may be used to communicatively connect the collector 102 to an external system or device. In such an embodiment, the connector 103 allows signals received by the collector 102 to be relayed to an external device or system. Exemplary external devices and/or systems may include those specifically configured to perform signal processing of radio signals received by the collector 102.

Figure 2:
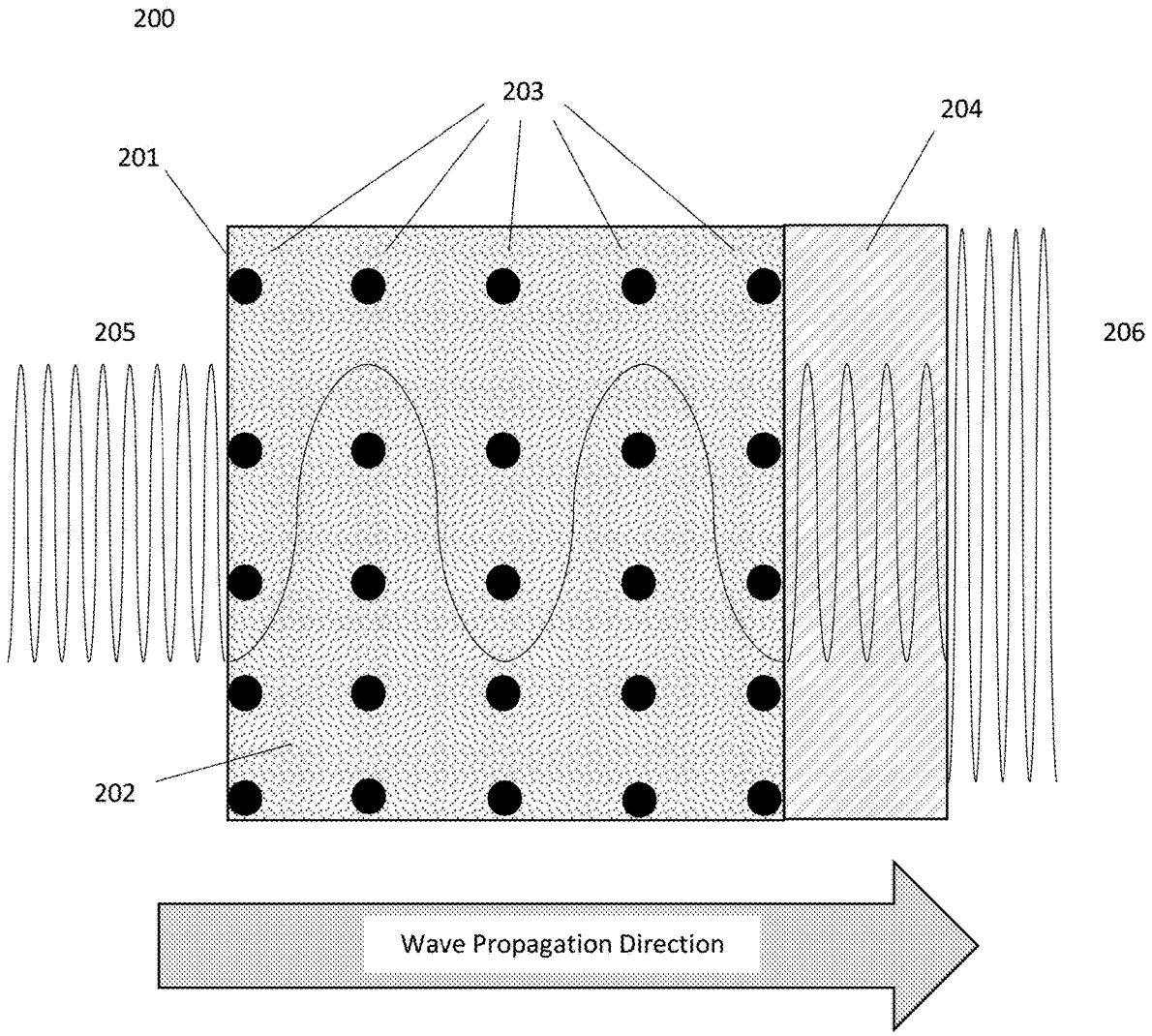
FIG. 2 illustrates a cross-sectional view of the coating and sidewall of a reflector, according to an exemplary embodiment of the present disclosure.

In another exemplary embodiment of the present disclosure and with reference to FIG. 2, a dichroic spherical antenna 200 comprises a coating 201 on the exterior surface of a reflector 204. The coating 201 comprises a plurality of ferromagnetic particles 203 distributed within the coating 201 and suspended by a medium 202. In one embodiment, the ferromagnetic particles 203 may by methyl methacrylate having a conductive coating. For example, the particles 203 may be highly spherical poly methyl methacrylate ("PMMA") microspheres having a radio frequency conductive silver coating. In such an example, the PMMA microspheres 203 may be between 125 and 150 micrometers in diameter and have a silver coating of approximately 250 nanometers thick. The density of such exemplary PMMA microspheres 203 may be approximately 1.2-1.3 grams per cubic centimeter. Although the particles 203 are shown as being spherically-shaped and being evenly distributed within the medium 202, particles 203 having shapes other than spherical and not being evenly distributed within the medium 202 may be utilized without departing from the embodiments contemplated herein. The medium 202 comprises a material suitable for the embodiments described herein, namely having desired characteristics for interacting with electromagnetic waves such as a dielectric constant and/or having the ability to suspend particles. In some embodiments, the medium 202 may comprise an epoxy, an epoxy-based, and/or an epoxy-type material, within which the particles 203 may be suspended. Although the coating 201 is shown as being on the exterior of the reflector 204, the coating 201 may be located on the interior of the reflector 204 or both the exterior and the interior of the reflector 204.

In another embodiment, the reflector 204 may be made from any rigid, semi-rigid, or pliable material. In an embodiment, the reflector 204 may be made from a material having a dielectric constant of approximately 2.1, such as nylon or Teflon, however other materials having other dielectric constants may be used without departing from the embodiments contemplated herein. The reflector 204 may be substantially spherically-shaped. In an embodiment, the interior of the reflector 205 may be held at vacuum. In some embodiments, the vacuum in the interior of the reflector 206 may be approximately 1 torr, however, other levels of vacuum may be used. Alternatively, the interior of the reflector 206 may be filled with a specific fluid or mixture of fluids. The fluids used may be gas(es) or liquid(s), or a combination thereof. Although the coating 201 is shown and described as being applied to the exterior of the reflector 204, the coating 201 may be applied to the interior of the reflector 204 and/or both the exterior and the interior of the reflector 204. Additionally, the medium 202 and/or the particles 203 may be embedded, in whole or in part, within the reflector 204 without departing from the embodiments contemplated herein.

In an exemplary embodiment, an electromagnetic wave 205 propagates to the antenna 200 from atmospheric conditions. In such an embodiment, the wave 205 interacts with the coating 201 having the medium 202 and the particles 203. In such an embodiment, the material properties of the coating 201, the medium 202 and/or the particles 203 cause the wave 205 to change characteristics. As shown, the wave 205 slows, causing the wave's 205 wavelength to increase. After the wave 205 propagates through the coating 201, the wave 205 propagates through the reflector 204. Due to the material properties of the reflector 204, the wave's 205 characteristics may again be altered. As shown, the wave's 205 frequency while propagating through the reflector 204 increases relative to the wave's 205 frequency while propagating through the coating 201. After propagating through the reflector 204, the wave 205 reaches the interior of the reflector 206, at which point the wave's 205 characteristics may change. As shown, the wave's 205 wavelength in the interior of the reflector 206 increases in frequency and increases in amplitude relative to the wave's 205 characteristics while propagating though the reflector 204.

The wave 205 and the antenna 200, including the coating 201, the medium 202, the particles 203, the reflector 204 and the interior 205 are shown and described for illustration purposes only and other sizes, characteristics, and/or densities may be used without departing from the embodiments contemplated herein. Although specific examples of the wave's 205 characteristics, including its wavelength, frequency, and amplitude, are shown and described as altering while the wave 205 propagates through the atmospheric conditions, the coating 201, the medium 202, the particles 203, the reflector 204 and the interior 206, the wave's 205 characteristics may be altered in other ways not shown and described without departing from the embodiments contemplated herein. Additionally, although "atmospheric conditions" are described in relation to typical human-habitable conditions, for example, open air at sea-level, the antenna 200 can be used in almost any condition or environment. For example, the antenna 200 may be used in water, such as being immersed in the ocean, in the vacuum of space, and/or in subterranean environments. Moreover, a specific embodiment of the antenna 200 is not limited to a specific environment. For example, the same embodiment of the antenna 200 may be used in the vacuum of space and in an aquatic environment.

Moreover, the wave 205, the coating 201, the medium 202, the particles 203, the reflector 204, and the interior 206 are shown and described for illustration purposes only and the relative sizes of which are not intended to be accurate but rather exemplary. For example, the coating's 201 thickness may be many times smaller than the reflector's 204 thickness. Similarly, although five particles 203 are shown as traversing the thickness of the coating 201, other embodiments may have many more or many less particles without departing from the embodiments contemplated herein. The density of the particles 203 within the medium 202 and coating 201 may be many times more or less than shown. Additionally, the wave 205 is shown and described as permeating the coating 201 and not interacting with the particles 203, however the wave 205 may interact with the particles 203 while propagating through the coating 201 in other embodiments without departing from the embodiments contemplated herein.

Figure 3:
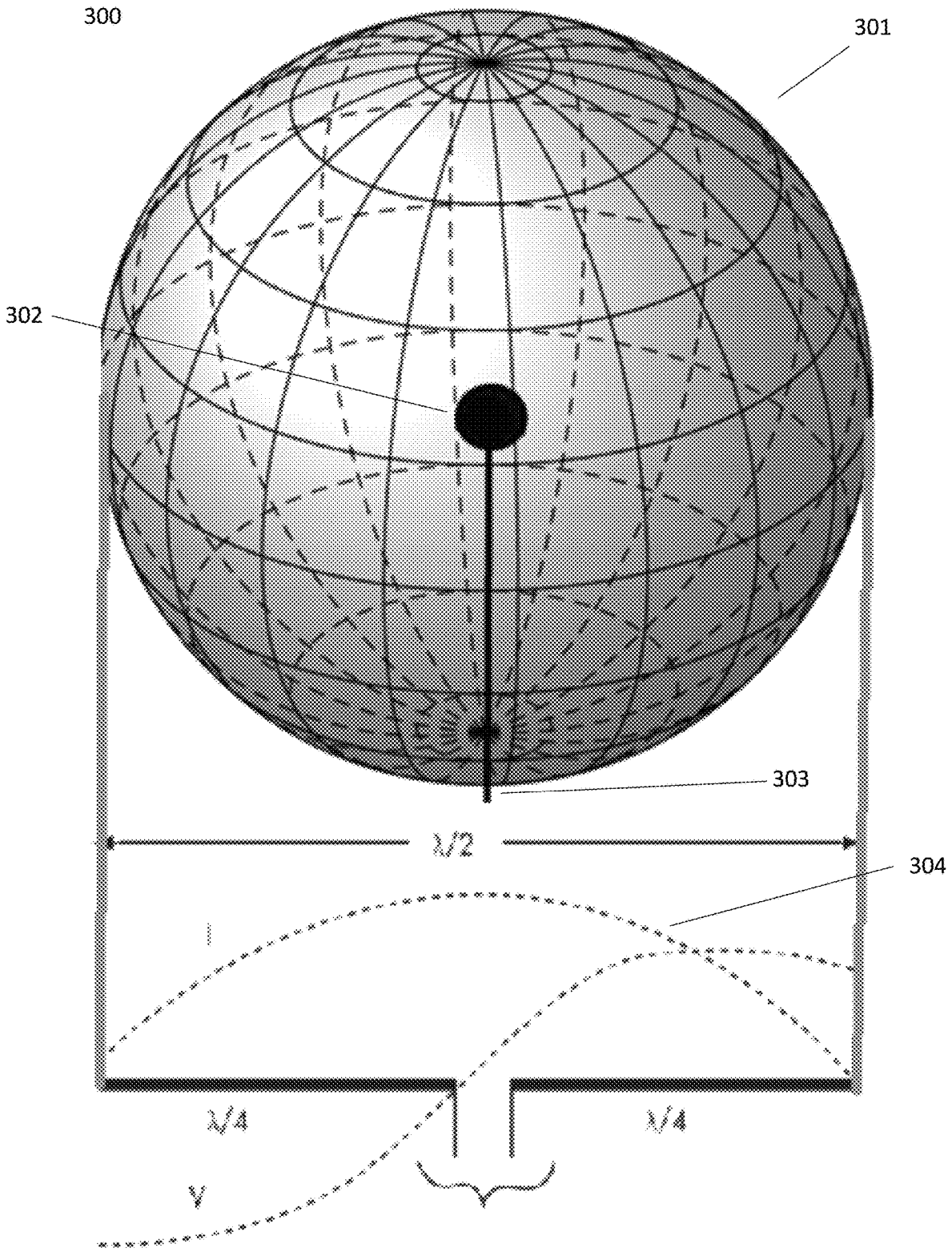
FIG. 3 illustrates an isometric view of a dichroic spherical antenna showing a reflector's size depending on the desired wavelength, according to an exemplary embodiment of the present disclosure.

In another exemplary embodiment of the present disclosure and with reference to FIG. 3, a dichroic spherical antenna 300 comprises a reflector 301 and a collector 302. The reflector 304 is sized according to the wave 304 to be received. In an embodiment, the reflector's 301 diameter is approximately equal to one-half of the desired wave's 304 wavelength (shown as "X"). The symbol "X" is generally understood in the art to represent the wavelength of an electromagnetic wave. The reflector's 301 diameter is approximately $\lambda/2$.

Although the collector 302 is shown as having a specific size relative to the wave 304 and the reflector 301, other sizes of the collector 302 may be used without departing from the embodiment contemplated herein. For example, in an embodiment wherein the antenna 300 is configured to receive a 2 GHz signal, the reflector's diameter is approximately 7.49808 cm. In some embodiments, the reflector's 301 diameter is within 1% of the desired wave's 304 wavelength. In the previous example configured to receive a 2 GHz signal, the reflector's 301 diameter is approximately 7.49808 cm+/−0.0749808 cm.

Figure 4:
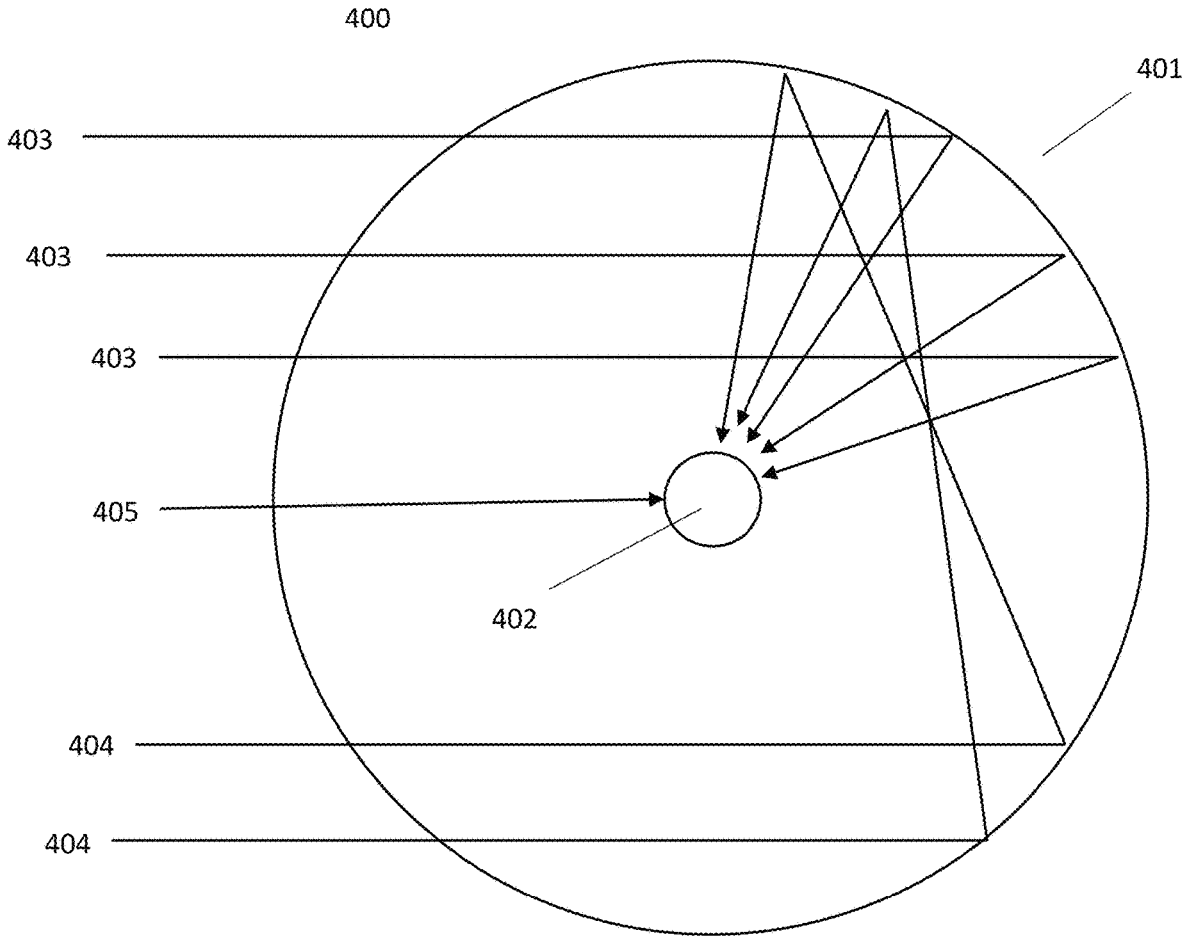
FIG. 4 illustrates radio waves propagating into a dichroic spherical antenna, according to an exemplary embodiment of the present disclosure.

In another exemplary embodiment of the present disclosure and with reference to FIG. 4, a dichroic spherical antenna 400 comprises a reflector 401 and a collector 402. In some embodiments, the reflector 402 comprises a low noise filter. Electromagnetic waves 403, 404, 405 propagate through the antenna's 400 ambient environment. The antenna's 400 ambient environment describes any environment in which the antenna 400 is used, including open air, immersed in a liquid, and/or a partial or total vacuum such as space. In an embodiment, the wave 403 propagates through the reflector 401 and does not directly propagate to the collector 402. In such an embodiment, the wave 403 bounces off the interior surface of the reflector 401 and is directed to the collector 402. The collector 402 receives the wave 403 and transmits it to an external device or system, the implementation of which is readily apparent to one skilled in the art. In another embodiment, the electromagnetic waves 404 propagate through the collector 401 and are not immediately received by the collector 402. In such an embodiment, the wave 404 bounces off the internal surface of the reflector 401 and is directed inward. In this example, the wave 404 bounces off the internal surface of the reflector 401 twice before being received by the collector 402. In another embodiment, the wave 405 propagates through the reflector 401 and is received by the collector 402 without bouncing off the interior surface of the reflector 401.

Although a dichroic spherical antenna has been shown and described in the context of a single antenna, dichroic spherical antennas may be implemented according to other embodiments of the disclosure. For example, a plurality of dichroic spherical antennas may be employed in a single application without departing from the embodiments contemplated herein. For example, an array comprising a plurality of dichroic spherical antennas may be used. In such an embodiment, each antenna in the array of antennas may be similarly configured. In such an embodiment, the array of antennas may be employed to increase the total sensitivity of the array. Such an embodiment is readily apparent to one skilled in the art and is referred to as "power stacking." In such an embodiment, the individual antennas are typically connected, directly or indirectly, to one-another and/or to a central processing unit or system. Such an embodiment allows the commonly-connected processing unit to receive signals received by the plurality of antennas in the array and perform the desired processes.

In other embodiments, some or all of the individual antennas in the array of antennas may be differently configured. For example, an array of dichroic spherical antennas may comprise antennas that are configured to receive electromagnetic waves of different wavelengths. In such an example, one of the plurality of antennas may be configured to receive a wave having a frequency of 2 GHz and anther antenna of the plurality of antennas may be configured to receive a wave having a frequency of 10 GHz. Because of the differing size requirements of the individual wavelengths and/or frequencies, such an exemplary array of dichroic antennas would comprise individual antennas having differing sizes, thereby allowing the array of antennas to receive a larger spectrum of wavelengths and/or frequencies than would be possible with a single antenna.

In an embodiment of the disclosure, the methodologies and techniques described herein are implemented as a dichroic spherical antenna comprising a reflector having a specialized coating and a reflector, implemented as a single antenna or in an array. The disclosure has been described herein using specific embodiments for the purposes of illustration only. It will be readily apparent to one of ordinary skill in the art, however, that the principles of the disclosure can be embodied in other ways. Therefore, the disclosure should not be regarded as being limited in scope to the specific embodiments disclosed herein, but instead as being fully commensurate in scope with the following claims.

I claim:

1. A dichroic spherical antenna comprising:

a spherically-shaped reflector having an exterior surface and an interior;

a collector disposed at the center of the interior; and a coating disposed on the exterior surface of the reflector;

wherein the coating comprises a plurality of ferromagnetic particles dispersed throughout a coating medium.

2. The dichroic spherical antenna of claim 1, wherein the coating medium is epoxy-based.

3. The dichroic spherical antenna of claim 1, wherein the plurality of ferromagnetic particles comprises polymethylmethacrylate microspheres.

4. The dichroic spherical antenna of claim 3, wherein the microspheres comprise a radio frequency conductive silver coating.

5. The dichroic spherical antenna of claim 3, wherein the microspheres are between 125 micrometers and 150 micrometers in diameter.

6. The dichroic spherical antenna of claim 1, wherein the collector is capable of receiving radio frequency band electromagnetic radiation.

7. The dichroic spherical antenna of claim 6 further comprising an RF connector.

8. The dichroic spherical antenna of claim 1, wherein the pressure inside the reflector's interior is less than the pressure outside the reflector.

9. The dichroic spherical antenna of claim 1, wherein the collector is disposed at the geometric focus of the reflector.

10. The dichroic spherical antenna of claim 1, wherein the reflector comprises a dielectric constant between 1.5 and 2.5.

11. A method of receiving radio signals comprising the steps of:

receiving, at a collector disposed inside a spherically-shaped reflector, electromagnetic radiation;

wherein the exterior of the reflector comprises a coating; and wherein the coating comprises ferromagnetic particles.

12. The method of receiving radio signals of claim 11, wherein the ferromagnetic particles comprise polymethylmethacrylate microspheres.

13. The method for receiving radio signals of claim 12, wherein the microspheres are between 125 micrometers and 150 micrometers in diameter.

14. The method of receiving radio signals of claim 11, wherein the frequency of the electromagnetic radiation is between 30 Hz and 3 THz.

* * * * *